US007194845B2

(12) United States Patent
Belleau

(10) Patent No.: US 7,194,845 B2
(45) **Date of Patent: *Mar. 27, 2007**

(54) STUCCO WALL BUILDING ARRANGEMENT

(76) Inventor: Michael R Belleau, 34 Hazel St., Salem, MA (US) 01970

( * ) Notice: Subject to any disclaimer, the term of this patent is extended or adjusted under 35 U.S.C. 154(b) by 0 days.

This patent is subject to a terminal disclaimer.

(21) Appl. No.: 10/690,460

(22) Filed: Oct. 21, 2003

(65) Prior Publication Data

US 2004/0182028 A1 Sep. 23, 2004

Related U.S. Application Data

(63) Continuation-in-part of application No. 09/854,641, filed on May 14, 2001, now Pat. No. 6,647,679, and a continuation-in-part of application No. 09/407,452, filed on Sep. 28, 1999, now Pat. No. 6,354,009, and a continuation of application No. 09/338,398, filed on Jun. 22, 1999, now Pat. No. 6,314,695.

(51) Int. Cl.
*E04G 21/00* (2006.01)

(52) U.S. Cl. ..... 52/745.09; 52/742.14; 52/309.12; 52/309.17; 52/446; 427/294; 427/350; 427/403

(58) Field of Classification Search ..... 52/309.17, 52/364, 446, 454, 741.41, 745.09, 742.14, 52/309.12; 427/294, 351, 403, 350
See application file for complete search history.

(56) References Cited

U.S. PATENT DOCUMENTS

| | | | | | |
|---|---|---|---|---|---|
| RE20,607 | E | * | 12/1937 | Tomec | 428/139 |
| 4,342,181 | A | * | 8/1982 | Truesdell | 52/742.13 |
| 4,349,398 | A | * | 9/1982 | Kearns et al. | 156/71 |
| 4,653,243 | A | * | 3/1987 | Burkett | 52/741.4 |
| 4,785,601 | A | * | 11/1988 | Tupman | 52/364 |
| 5,389,317 | A | * | 2/1995 | Grimmer | 264/46.5 |
| 5,410,852 | A | * | 5/1995 | Edgar et al. | 52/408 |
| 5,423,154 | A | * | 6/1995 | Maylon et al. | 52/371 |
| 6,076,320 | A | * | 6/2000 | Butler | 52/294 |
| 6,314,695 | B1 | * | 11/2001 | Belleau | 52/309.17 |
| 6,354,009 | B1 | * | 3/2002 | Belleau | 30/475 |
| 6,807,786 | B1 | * | 10/2004 | Peck | 52/514.5 |

* cited by examiner

*Primary Examiner*—Jeanette E. Chapman
(74) *Attorney, Agent, or Firm*—Don Halgren

(57) ABSTRACT

The present invention comprises a stucco wall structure for a building. The wall substrate is arranged for receipt of subsequent layers of surface material. The margin or periphery of said wall to be treated has a screed attached thereto. A sprayed-on coating of urethane is applied onto the wall substrate between the screeds to insure continuous bonding and adherency to the substrate. A first layer of polymer-based base coat and mesh covering is applied to the sprayed-on coating of urethane to provide anchoring and adhesion of a subsequent layer of stucco. An outer layer of stucco applied over the first layer of polymer-based base coat as a final coat thereon.

2 Claims, 2 Drawing Sheets

STUCCO WALL BUILDING ARRANGEMENT

This invention relates to methods and apparatus of building construction, and more particularly to the application of stucco to the wall of a building, and is a continuation of my earlier patent application Ser. No. 09/338,398, filed Jun. 22, 1999, now U.S. Pat. No. 6,314,695 and continuation-in-part application Ser. No. 09/407,452, filed Sep. 28, 1999, now U.S. Pat. No. 6,354,009 and continuation-in-part application Ser. No. 09/854,641 filed May 14, 2001 now U.S. Pat. No. 6,647,679 each of which were serially and each of which are incorporated herein by reference.

BACKGROUND OF THE INVENTION

1. Field of the Invention
2. Prior Art

Stucco is a building finish that is applied to walls of those buildings, to make them weather proof and have a finished appearance. Stucco has been used primarily in the Southwest and South of the United States prior to the introduction of improved insulating techniques. Those insulating techniques typically include the use of elongated blocks of a pre-formed rigid open cell polystyrene. These polystyrene blocks are held on to a wall surface by mechanical fasteners, or by being adhered to the wall substrate with an adhesive. In this prior art practice, once those polystyrene foam insulation blocks are fixably attached to the wall, they are roughened by a rasp to permit a base coat of polymer paste reinforced with a fiberglass fabric mesh, to help bind subsequent material to that foam, and to unify those blocks together. That mesh in the prior art method, would be placed over the roughened outer surfaces of those blocks of foam on a base coat of cementitious material while still wet, to embed that mesh in the base coat. The base coat of cementitious material and mesh are trowelled smooth and made generally planer, to be parallel with the surface of the original wall. A finish coat of synthetic stucco would then be applied to the base coat of the cementitious material.

The problem of the prior art, however, remains that the polystyrene boards are used as discrete, separate gap-maintaining blocks, and may supported by array of channels or grids or adhesive to attach them to a wall. Any gap or crack between the adjacent blocks or gap between the blocks and the wall substrate permits the infiltration/migration of water, which then seeps into the existing walls surface and causes mildew, moisture build-up, rot and wall deterioration. Joints between the adjacent boards may induce cracking in the outer surface layers of material if those boards are not installed tightly against one another and the wall.

It is an object of the present invention, to provide a stucco wall construction arrangement which prevents water intrusion and migration into the wall structure, and which will overcome those typical problems of the prior art.

It is a further object of the present invention, to provide a stucco wall construction which will prevent the infiltration of water into the existing wall surface.

It is still yet a further object of the present invention, to provide a stucco construction arrangement which is easily applied, readily modified to accommodate variations in base wall surface characteristics, and permit an even outer surface for subsequent coat applications.

It is yet still a further object of the present invention to provide a stucco construction arrangement that is fast, easily applied, energy efficient, strong and which will outlast the prior art stucco construction by many years.

BRIEF SUMMARY OF THE INVENTION

The present invention relates to a method and apparatus for the application of multiple layers of material to an existing wall, so as to produce a water impenetrable Masterbond™ stucco structure.

In the application of the present method of constructing such a stucco wall structure, the pre-existing wall may be pressure washed if dirty, cleaned, rinsed and air dried. The pre-existing wall may be any type of structure such as wood, brick, or cement. After the wall has been properly washed and dried, an arrangement of orientation screeds is applied to the vertical margins of the wall, as well as to the periphery of any windows or doors. A screed is a border support for the insulation to be sprayed against. A screed, in one embodiment, may be an elongated member which is attached to the peripheral margins of the wall, to define the area in which a foam urethane is to be sprayed. The screed in this embodiment, has a "shiplap" shape, or a cross-section of generally "L" shape having a shoulder on its spray foam adjacent edge, so as to provide a "key" or "locking effect" onto the foam, which is to be subsequently sprayed onto the wall surface. The screed, of course, is attached to the wall by an adhesive and/or mechanical fasteners. A further embodiment of screeds, is the use of an extruded generally "J"-shaped channel arrangement having one side edge which is attached by adhesives and or mechanical fasteners, to the margins of the wall and to the periphery of any door or window openings thereon. The U-shaped channel member screed has its open edge directed toward the area of the wall to be subsequently foam sprayed. The use of such a channel screed also provides a method of determining the thickness of subsequent application of foam urethane.

The next step in the construction of a stucco wall, is to cover any openings with plastic, prior to the application of the foam spray so as to prevent any inadvertent overspray into undesired areas.

The foam urethane is spray-applied in a thickness of approximately ¼ inch over the final specified insulation thickness, applied to the wall in preferably one pass, so as to provide a secure and continuous bonding between the foam spray and that entire wall substrate. This continuous application of a single monolithic layer of foam to an entire wall surface enhances the bonding to that wall and eliminates the subsequent water migration between the wall and the urethane spray foam layer of a Masterbond™ stucco structure application.

After the spray has been applied to the entire wall surface, a skin outer surface is developed thereon. After the spray foam has been applied to one entire wall, that foam spray outer layer is vacuum planed, to remove surface irregularities and expose the cell structure of that foam spray, for secure adhesive gripping of a bond coat of stucco and mesh. The vacuum planing is accomplished by a hand-guidable elongated rotary blade device which planes off the irregularities of polyurethane foam spray material to the desired thickness, as initially guided by the orientation screeds. The vacuum plane typically has one end which may ride on the screeds to provide initial control of the planing operation. The elongated vacuum plane is also flexibly connected, via an elongated, flexible hose, to a suction source, in which to permit the removal of foam spray particulate matter swept off by the rotary blades thereof, and into a holding container.

Once the spray foam layer has been properly vacuumed planed and flattened to the desired thickness, an application of polymer base bond coat of cementitious material and a thin mesh is applied adhesively thereto, in a thickness of about 1/16 of an inch as a first coat. The mesh and base coat are allowed to dry over a period of about twelve hours. A second coat of polymer based base coat with no mesh therewith, is applied as thin (i.e. 1/16 inch) an outer coat over the base coat in preparation for the final coat. The outermost coat of stucco is then applied to a minimum thickness of about 1/16 of an inch thick.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENTS

Figure 1:
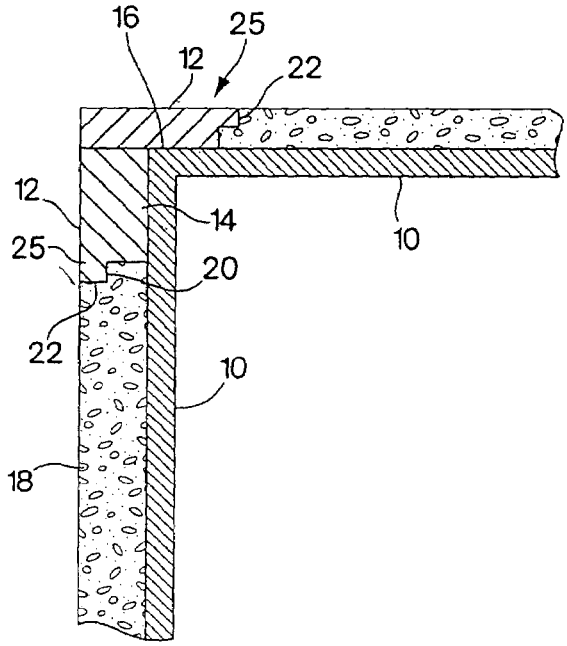
FIG. 1 is a plan view, in section, of a corner of a wall of a building, showing a screed and foam spray thereon.

Referring now to the drawings in detail, and particularly to FIG. 1, there is shown the present invention which comprises a method and apparatus for the application of multiple layers of material to an existing wall, so as to produce a water impenetrable Masterbond™ stucco wall structure.

Figure 2:
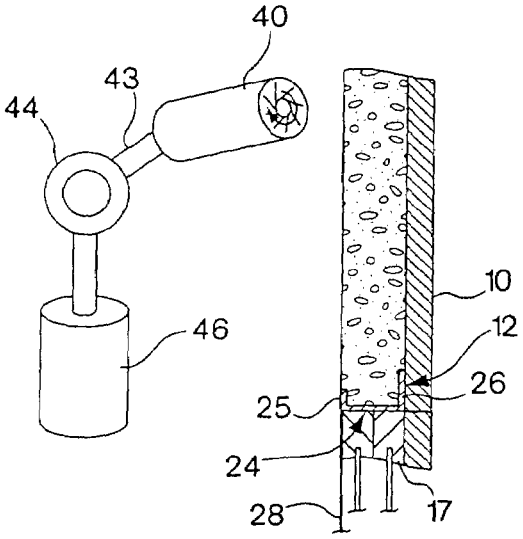
FIG. 2 is a plan view, in section of a portion of a wall structure with a screed and foam spray application thereon.
Figure 3:
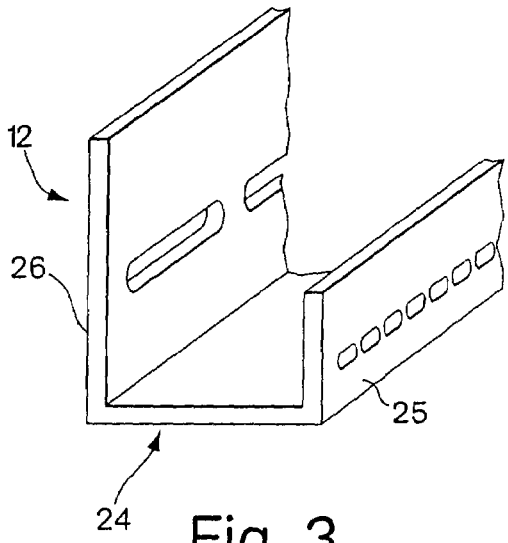
FIG. 3 is a view of "J" shaped screed, in perspective, for use against a wall or opening thereon.

In the application of the present method of constructing such a stucco wall structure such as shown in FIG. 1 in a plan view, in partial section, shows a pre-existing wall 10 which may be pressure washed, rinsed and air dried. The pre-existing wall 10 may be any type of structure such as wood, brick, or cement. After the wall 10 has been properly cleaned, i.e. washed and dried, an arrangement of orientation screeds 12 is applied to the vertical margins 14 and 16 of the wall 10, as well as to the periphery of any windows or doors 17. A screed 12, in one embodiment, as exemplified in FIG. 1, may be an elongated member which is attached to the peripheral margins of the wall 10, to define the area in which a foam urethane 18 is to sprayed. The screed 12 in this embodiment shown in FIG. 1, is of "L" shape in cross-section, and has a shoulder 20 on its inwardly facing edge 22, so as to provide a "key" or "locking effect" onto the foam 18, which foam is to be subsequently sprayed onto the entire planar surface of the particular wall 10 being treated, between the arrangement of the screeds 12. The screeds 12 are attached to the wall 10 by adhesive end or mechanical fasteners, not shown. A further embodiment of the screed 12, is the use of an extruded generally "J"-shaped channel arrangement 24 having one side edge 26, as shown in FIGS. 2 and 3, which screeds are attached by adhesives and or mechanical fasteners, to the margins of the wall 10 and to the periphery of any door or window openings thereon. The "J"-shaped channel member screed 24 has its open edge directed toward the area of the wall to be subsequently foam sprayed, as may be viewed in FIG. 2. The use of either such a "J" shaped (in cross-section) channel screed 24, or an "L" shaped screed 22 also provides a method of controlling the thickness of subsequent application of foam urethane spray 18 by setting their outer surface 25 as the outer limit for such urethane spray 18 during a subsequent planing operation.

The next step in the construction of a Masterbond™ stucco wall, is to cover any openings with a sheet of plastic film 28, prior to the application of the foam spray 18, so as to prevent any inadvertent overspray into undesired areas.

The foam urethane 18 is then pressurizably "spray-applied" in a thickness of approximately 1/4 inch more than the final specified thickness applied to the open surface of the wall 10 in one pass, so as to provide a secure and continuous bonding between the foam spray 18 and that entire wall substrate 10. This continuous application of a single layer of foam 18 to an entire surface of the wall 10 enhances the bonding between the wall substrate and the spray foam 18, and thereby eliminates the subsequent water migration between the wall 10 and the insulation layers 18 of the stucco application.

Figure 4:
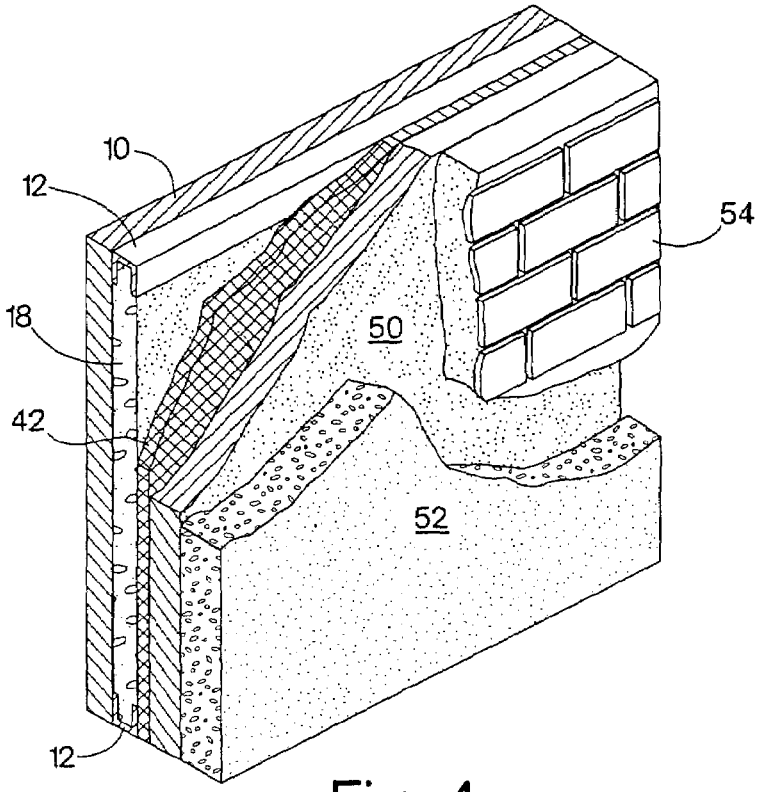
FIG. 4 is a side elevational view of a wall structure, with portions broken away, to show a representation of the layers of material thereon, which comprises the present invention.
Figure 5:
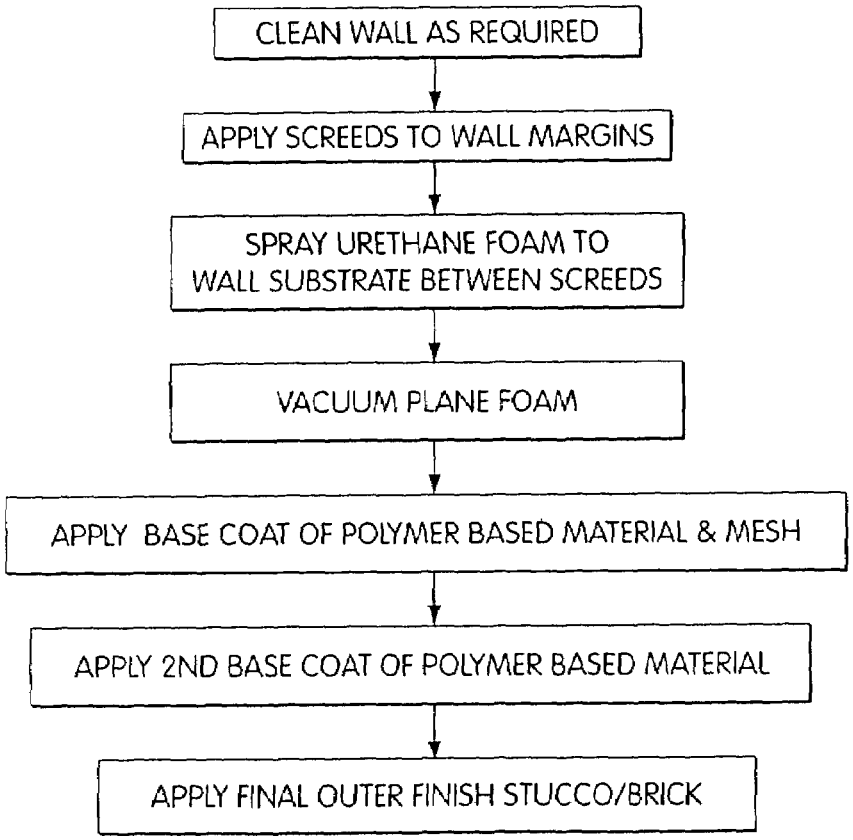
FIG. 5 is a procedural outline of the methodology of the present invention.

After the foam spray has been applied to the entire surface of the wall 10, an outer skin surface of closed cell film is developed thereon. After the spray foam 18 has been applied to one entire wall, that foam spray and outer layer is "leveled and textured" a vacuum planer 40 to remove surface irregularities and expose the cell structure of that foam spray 18 for secure adhesive gripping of a subsequent bond coat of base coat and mesh 42, the layers being shown in FIG. 4. The vacuum planing is accomplished by a hand-guidable, elongated, vacuum planer 40, shown in an end view in FIG. 2, which planer 40 which rotatively scrapes off a swath of polyurethane foam material by a rotating blade, to leave the desired urethane foam thickness on the substrate of the wall 10, as guided by the screeds 12. One end of the planer 40 may be held onto (rides on) those screeds 12 for such guidance. Once the foam 18 on the wall is flattened to the specified thickness, the vacuum planer 40 will no longer cut foam because of the configuration of the frame of the planer 40 and its blades. The elongated vacuum plane 40, during cutting, is flexibly connected via a flexible hose 43, to a suction source 44, that vacuums away the foam particles as they are scraped, and directs that foam spray particulate matter into a holding container 46.

Once the spray foam layer has been properly flattened to the desired thickness, an application of a polymer-based base coat and a thin mesh 42 applied adhesively thereto, in a thickness of about 1/16 of an inch as a first outer coat and flattened with a darby (an elongated trowel about 30" long to ensure a flat surface on the base coat). The mesh and bond coat of polymer based base coat 42 are allowed to dry over a period of about twelve hours. In a preferred embodiment, a second coat of base coat 50 is applied as an outermost coat over the bond coat 42. This outermost coat of polymer-based base coat 50 is applied to a minimum of about 1/16 of an inch thick without any mesh therewith. The final coat of stucco 52 is applied to the second base coat 50.

A further embodiment comprises a thin applique or sheet/layer 54 of brick face in place of the final coat of stucco 52. These brick face sheets 54 may be pressed onto the second polymer-based base coat 50.

Thus what has been shown and disclosed is a novel arrangement for the application of insulation and stucco to a wall substrate. It is noted that the wall to be covered may in a further embodiment, be an inside wall, the foam spray comprising inside insulation and a base layer for subsequent layers of interior wall surfaces/decorations.

I claim:

1. A method of insulating and finishing a vertical wall structure which is impervious to water, comprising the steps of:

cleaning a surface of said wall structure to be treated;

applying a plane-guiding screed arrangement having a certain thickness, to the peripheral margins of said surface of said wall to be treated;

spraying a urethane foam directly onto said surface of said wall structure defined within said screed arrangement;

applying a first irregularly-surfaced coat of polymer enhanced base coat and mesh onto said sprayed-on coat of urethane foam;

vacuum planing said sprayed-on coat of urethane foam with an elongated vacuum planer prior to application of said first coat of polymer-based base coat and mesh to said thickness of said screed; and applying a stucco finish material onto said sprayed layer of urethane foam and said first coat of polymer enhanced base coat and mesh beyond said thickness of said screed.

2. The method as recited in claim 1, including the step of:

guiding said vacuum planer at one end thereof, by riding said planer on said screed, to facilitate proper thickness planing of said urethane foam.

* * * * *